United States Patent [19]

Csaszar

[11] Patent Number: 4,669,623

[45] Date of Patent: Jun. 2, 1987

[54] CONTAINER WITH DOUBLE BEAD TRACK SYSTEM AND FRANGIBLE CLOSURE

[75] Inventor: Ernest J. Csaszar, Mountainside, N.J.

[73] Assignee: General Kap Corporation, Bound Brook, N.J.

[21] Appl. No.: 750,032

[22] Filed: Jun. 28, 1985

[51] Int. Cl.[4] ..... B65D 41/34

[52] U.S. Cl. ..... 215/252; 215/258

[58] Field of Search ..... 215/252, 258

[56] References Cited

U.S. PATENT DOCUMENTS

| | | | |
|---|---|---|---|
| 4,343,408 | 8/1982 | Csaszar | 215/252 |
| 4,436,212 | 3/1984 | Llera | 215/252 |
| 4,461,390 | 7/1984 | Csaszar | 215/252 |
| 4,479,586 | 10/1984 | Csaszar | 215/252 |

FOREIGN PATENT DOCUMENTS

| | | |
|---|---|---|
| 931200 | 7/1963 | United Kingdom . |
| 1163203 | 9/1969 | United Kingdom . |

*Primary Examiner*—Donald F. Norton

*Attorney, Agent, or Firm*—Lerner, David, Littenberg, Krumholz & Mentlik

[57] ABSTRACT

Tamper-evident containers are disclosed, including a container body with a neck portion and an annular collar portion below the neck portion, and a closure for application to that container body. The closure includes a one-piece closure body including a horizontal end wall and a cylindrical side wall having a depending lower skirt portion with an inwardly projecting bead having a predetermined length. The intermediate side wall portion of said closure includes an area of weakness designed to fracture when the closure is removed from the container body so as to leave the depending lower skirt portion on the container body after the upper portion of the closure has been removed, and the annular collar portion of the container body includes an upper raised portion, a lower raised portion, and a central depressed portion therebetween, the central depressed portion having a diameter less than the diameter of the upper and lower raised portions, and having a length substantially corresponding to the predetermined length of the inwardly projecting bead. In this manner, the inwardly projecting bead can be locked between the upper raised portion and the lower raised portion in order to facilitate fracture of the frangible portion of the closure as the closure is removed from the container body.

16 Claims, 11 Drawing Figures

CONTAINER WITH DOUBLE BEAD TRACK SYSTEM AND FRANGIBLE CLOSURE

FIELD OF THE INVENTION

The present invention is directed to tamper-evident containers. More specifically, the present invention is directed to tamper-evident plastic containers which include closures having a frangible portion which is designed to fracture when the closure is removed from the container, thereby evidencing the fact that the container has been opened. Still more particularly, the present invention is directed to such containers including means for insuring that the fracture of the frangible portion of the closure is clean and consistent, and that the tamper-evident container performs that function essentially each time it is employed.

BACKGROUND OF THE INVENTION

Applicant has previously disclosed and patented a commercially significant improvement upon those prior plastic and metal closures for bottles and containers which are designed to include a tamper-evident feature. In most cases, this tamper-evident feature had comprised a lower shoulder or skirt portion of the closure, which was in some way intended to fracture or break upon removal of the closure from the container, so that it then became evident that the container had been opened. A large number of these closures had been known in the past, including even several which were used on a commercial basis, particularly in connection with carbonated beverage bottles and other such containers maintained under significant pressures. Up until quite recently, metal closures had predominated in this respect. However, applicant's prior invention, as set forth in U.S. Pat. No. 4,343,408, has been quite successful in replacing these prior closures.

In that regard, applicant's patented closure has significantly improved upon these prior closures, particularly in that applicant's device has now permitted the closure to be removed cleanly and efficiently, and to obtain the fracture of the lower skirt portion in a highly reliable manner. Furthermore, applicant has provided a commerical closure which can be applied in a single step to a container or bottle, and one which can at the same time result in highly efficient breaking or fracturing upon closure removal.

Applicant has also patented a further improvement on this closure, which includes juxtaposed parallel intermediate side wall surfaces which help to maintain the upper and lower intermediate side wall portions of these closures in alignment with each other upon collapse of the frangible bridge means as the closures are applied to the containers, and thus more efficiently operate such systems. These improved devices are set forth in U.S. Pat. No. 4,461,390. Again, all of these closures have been highly successful in commercially adapting these closures to these types of containers.

Furthermore, in U.S. Pat. No. 4,479,586 the applicant has set forth yet another improvement in these closures, in this case relating to the inclusion of means for insuring that the portion of the closure which remains on the container after the closure has been removed now separates from the upper portion of the container so as to visibly reveal fracture thereof. In this patent, this is accomplished by including an inwardly directed nonlocking tapered surface on the container itself so that when the closure fractures the depending lower skirt portion is caused to move downwardly along the nonlocking tapered surface away from the annular collar portion of the contained to provide such visual evidence.

While all of these closures and containers have provided commercial products which can not only provide the tamper-evident function, but which can also visibly demonstrate same, the search has nonetheless continued for even greater improvements in these devices, and most particularly to provide a structure which is foolproof in connection with highly repetitious operations. It must be recognized in this regard that in applying these closures to bottles or other containers many hundreds of thousands of applications are carried out repetitiously. It is nevertheless important that each such application result in the clean and uniform application of the closure to the container, without prematurely fracturing the bridges on the closure, and in a manner such that when the closure is subsequently removed these bridges will then cleanly and uniformly fracture with relative ease. Thus, even if only a few percent of the closures thus applied do not perfectly meet these requirements, in many situations this will not be an acceptable result in the particular commercial operation involved.

SUMMARY OF THE INVENTION

In accordance with the present invention, it has now been discovered that an essentially fool-proof commercial closure can be produced employing the essential characteristics of the aforementioned U.S. patents of the present applicant, but by further modifying the container itself. In particular, applicant has now discovered that these objects may be accomplished by providing a tamper-evident container including a container body having a neck portion and an annular collar portion below the neck portion, and a closure for application to the container body, the closure including a one-piece closure body having a horizontal end wall and a cylindrical side wall, the cylindrical side wall including an upper portion, a depending lower skirt portion, and an intermediate side wall portion therebetween, and the depending lower skirt portion including an inwardly projecting bead having a predetermined length, the intermediate side wall portion of the closure including a frangible portion comprising an area of weakness designed to fracture when the closure is removed from the container body so as to leave the depending lower skirt portion on the container body after the upper portion has been removed from the container body, the annular collar portion of the container body including an upper raised portion, a lower raised portion, and a central depressed portion therebetween, the central depressed portion having a diameter which is less than the diameter of the upper and lower raised portions, and having a length which substantially corresponds to the predetermined length of the inwardly projecting bead on the depending lower skirt portion of the closure, such that the inwardly projecting bead can be locked between the upper raised portion and the lower raised portion of the annular collar portion of the container body in order to facilitate fracture of the frangible portion of the closure as the closure is removed from the container body.

In accordance with one embodiment of the tamper-evident container of the present invention, the diameters of both the upper raised portion and the lower raised portion are less than the diameter required to provide for consistent fracture of the frangible portion of the closure upon removal of the closure from the container body.

In accordance with another embodiment of the tamper-evident container of the present invention, the frangible portion divides the intermediate side wall portion into an upper intermediate side wall portion and a lower intermediate side wall portion above and below the frangible portion, respectively, the frangible portion comprising bridge means located circumferentially around the closure, the bridge means being sufficiently thin and flexible so as to be capable of collapsing when the inwardly projecting bead passes over the upper raised portion of the annular collar portion of the container as the closure is being applied to the container, to thereby permit the upper and lower intermediate side wall portions to abut against each other and thereby permit the closure to be applied to the container without fracturing the bridge means.

In accordance with another embodiment of the tamper-evident container of the present invention, the depending lower skirt portion of the closure has a predetermined length, that length being such that upon complete application of the closure to the container body the inwardly projecting bead is locked between the upper raised portion and the lower raised portion of the annular collar portion of the container body.

In accordance with another embodiment of the tamper-evident container of the present invention, the depending lower skirt portion of the closure has a predetermined length, that predetermined length being such that upon complete application of the closure to the container body the inwardly projecting bead is located below the lower raised portion of the annular collar portion of the container body, whereby upon removal of the closure from the container body the inwardly projecting bead passes over the lower raised portion of the annular collar portion of the container body and becomes locked between the upper raised portion and the lower raised portion of the annular collar portion of the container body to thereby facilitate fracture of the frangible portion of the closure as the closure is further removed from the container body, and furthermore whereby upon subsequent reapplication of the upper portion of the closure to the container body, the upper portion of the closure forces the depending lower skirt portion of the closure downwardly over the lower raised portion of the annular collar portion of the container body so as to provide visual evidence of the fracture.

In accordance with another embodiment of the tamper-evident container of the present invention, the neck portion of the container comprises a threaded neck portion, and the upper portion of the cylindrical side wall of the closure comprises an internally threaded upper portion.

In accordance with another embodiment of the tamper-evident container of the present invention, the upper and lower intermediate side wall portions are in substantial alignment with each other in the plane of the cylindrical side wall.

In accordance with another embodiment of the tamper-evident container of the present invention, at least a portion of the upper and lower intermediate side wall portions include juxtaposed, parallel surfaces to provide surfaces for abutment of the upper and lower side wall portions upon collapse of the bridge means. Preferably, the lower intermediate side wall portion includes a plurality of stabilizer members.

In accordance with another embodiment of the tamper-evident container of the present invention, the bridge means comprises a plurality of bridge means located circumferentially around the closure. Preferably eight of these bridge members are located equidistantly about the closure.

In accordance with another embodiment of the tamper-evident container of the present invention, the inwardly projecting bead includes an inclined lower surface defining a plane disposed at a first angle with respect to the horizontal, for assisting in the gradual outward bending of the depending lower skirt portion as it passes over the upper raised portion of the annular collar portion of the container body upon application of the closure onto the container body without fracturing the frangible portion, and an inclined upper portion defining a plane disposed at a second angle with respect to the horizontal for engagement with the upper raised portion of the annular collar portion of the container body when the inwardly projecting bead is locked between the upper raised portion and the lower raised portion of the annular collar portion of the container body, the second angle being greater than the first angle whereby the depending lower skirt portion cannot gradually bend outward when the closure is removed from the container body without causing fracture to occur.

In accordance with another embodiment of the tamper-evident container of the present invention, the bridge members have a thickness of between about 0.003 and 0.015 inches.

BRIEF DESCRIPTION OF THE DRAWINGS

The tamper-evident container of the present invention can be further understood with reference to the drawings herein wherein.

DETAILED DESCRIPTION

Figure 1:
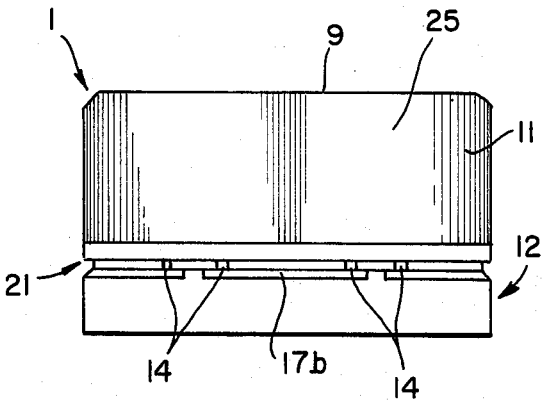
FIG. 1 is a side, elevational view of one embodiment of the closure used in connection with the tamper-evident container of the present invention.
Figure 4:
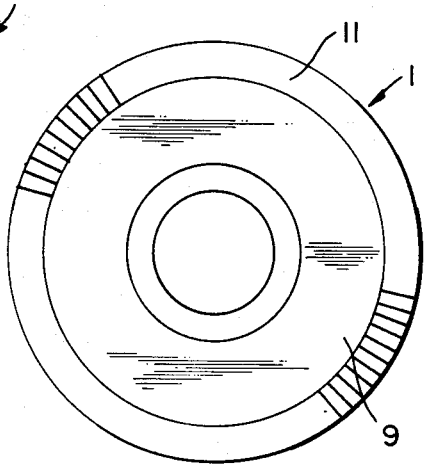
FIG. 4 is a top, elevational view of the closure of FIG. 1.

Referring specifically to the figures, in which like numerals refer to like portions thereof, FIG. 1 shows a closure 1 for use in connection with the tamper-evident container of the present invention. Furthermore, in FIG. 5 the closure 1, which is preferably manufactured from a thermoplastic material, is completely threaded onto a bottle or container body 3. In this case, the bottle itself includes a threaded neck portion 5 and an annular collar 7 therebelow. This annular collar 7 has in the past been referred to as a transfer bead, since it has been formed in connection with the manufacture of certain types of bottles (generally glass bottles) in order to assist in the transfer or movement of the bottles during its formation, or the bottle has also in the past included separate transfer beads below the annular collar portion 7. In accordance with the present invention, however, the annular collar portion 7 constitutes an essential element of the present invention, and is quite different from those annular collar portions previously known, such as those shown in applicant's prior U.S. Pat. Nos. 4,343,408, 4,461,390, and 4,479,586. In this case, as can be most clearly seen in FIGS. 6 and 8–11, the annular collar portion 7 now includes an upper raised portion *7a*, a lower raised portion *7b*, and a central depressed area *7c* therebetween. The central depressed area *7c* can thus form essentially a "track" into which the depending lower skirt portion 12 of the closure can be locked prior to fracture of the closure upon removal from the container body.

A significant aspect of this invention relates to the commercial environment in which these closures are employed. In many cases it is thus desirable to apply the closures by means of high speed equipment which automatically applies the completed closures to the container bodies. This requries equipment which performs the turning procedure for application of the threaded closure to the threaded container body. However, in doing so a rather high torque can be applied to the closure, thereby increasing the chances for premature fracture of the bridges on the closure during initial closure application. In connection with the container bodies such as those shown in applicant's prior U.S. Pat. No. 4,461,390, this problem could be overcome by merely reducing the diameter of the annular collar 7. However, while this could entirely eliminate this problem of potential premature fracture, it could also increase the likelihood that the closure could now also be removed from the container without fracturing the closure. This, of course, could destroy the entire function of these device. In the case of the present invention, this serious problem is solved by first reducing the diameter of the upper raised portion *7a*, as compared to the diameter of the annular collar 7 in the prior container bodies, but by then adding the lower raised portion *7b* and the central depressed area *7c* thereto. In this manner practically error-free closure application by means of automatic equipment can be obtained, along with essentially complete fracture reliability upon later closure removal.

Figure 9:
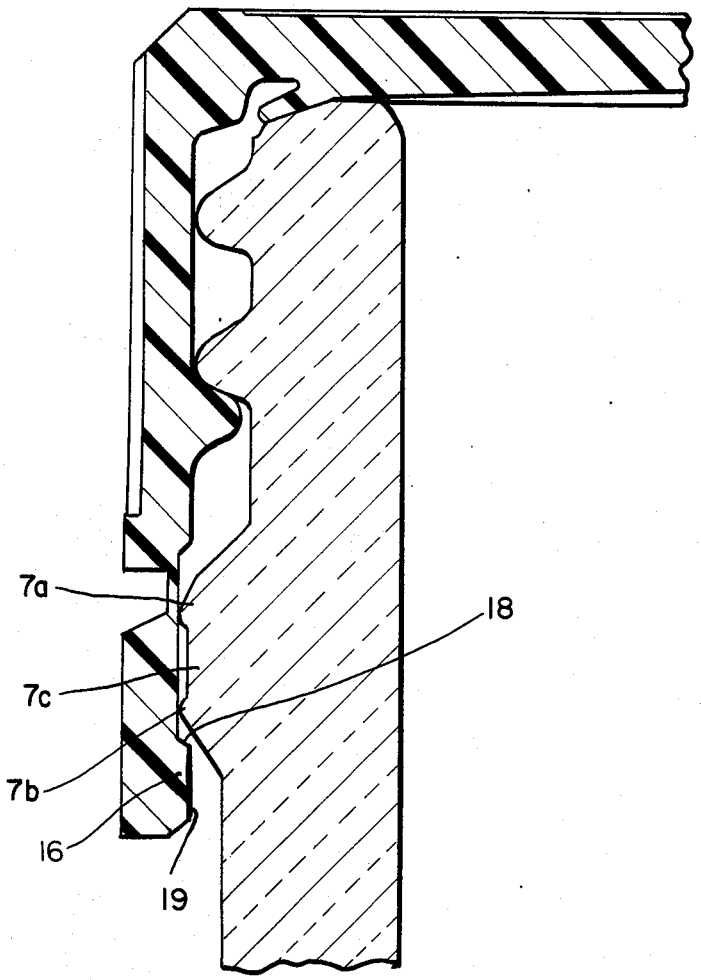
FIG. 9 is a partial, side, elevational, cross-sectional view of a portion of another tamper-evident container of the present invention, as applied.

Referring once again to the closure 1, it includes an upper horizontal end wall 9, and an internally threaded upper portion 11, which will correspond to the threaded neck portion 5 of the container body 3 to which it is to be applied. The portion of the closure 1 which is either below the upper raised portion *7a* or below the lower raised portion *7b* when the closure is completely threaded onto or otherwise applied to the container body 3, includes depending lower skirt portion 12. The inner surface of this depending lower skirt portion 12 includes an annular bead 16, which can best be seen in FIG. 6, and which includes an upper surface 18 and a lower surface 19. The lower surface 19 of bead 16 preferably has a gradual inclined or tapered surface, so that as the closure is being threaded or otherwise applied to the container and the surface 19 comes in contact with the upper surface of upper raised portion *7a* of the bead 7, the entire skirt portion 12 is gradually forced outwardly until it snaps over this upper raised portion *7a*, and thus into the central depressed portion or "track" *7c*. The closure is thus completely applied to the container in the configuration shown in FIG. 5. On the other hand, in the embodiment of the invention as shown in FIG. 9, where the depending lower skirt portion 12 has a significantly greater length, as the closure is further applied to the container body, the surface 19 will then come into contact with the upper surface of the lower raised portion *7b* of the bead 7, and the entire skirt portion 12 will then again be gradually forced outwardly until it snaps over this lower raised portion *7b*, thus into the configuration shown in FIG. 9 therebelow.

Figure 5:
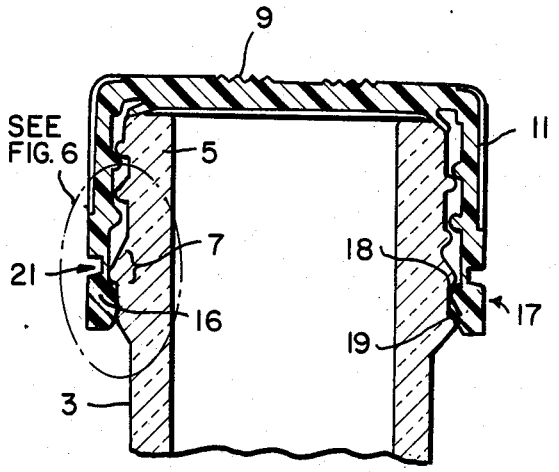
FIG. 5 is a side, elevational, cross-sectional view of a tamper-evident container of the present invention.
Figure 8:
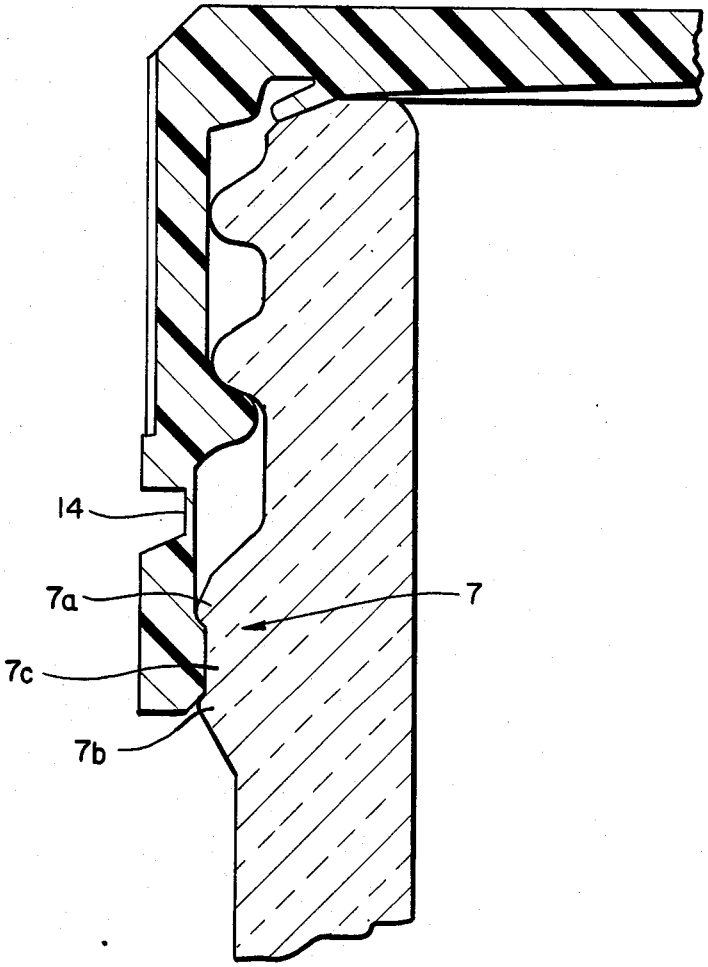
FIG. 8 is a partial, side, elevational, cross-sectional view of a portion of a tamper-evident container of the present invention, as applied.
Figure 10:
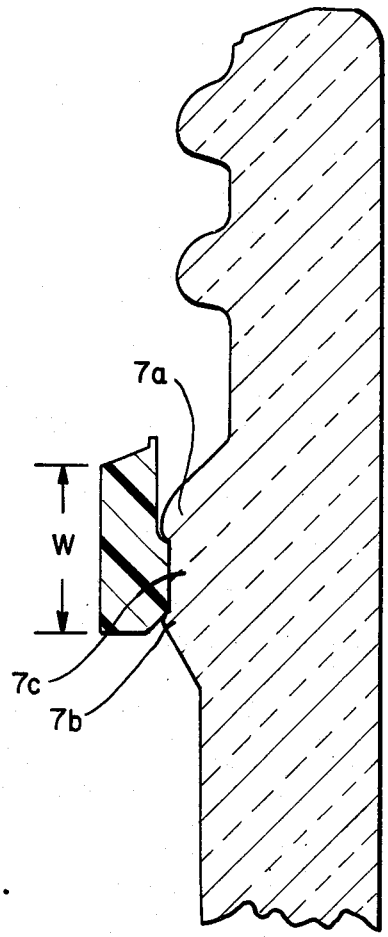
FIG. 10 is a side, elevational, partly cross-sectional view of the depending lower skirt portion of the tamper-evident closure of FIG. 8, subsequent to fracture.

The upper surface 18 of bead 16, which is at an angle with respect to the horizontal which is less than that of the lower surface 19, can thus firmly engage the corresponding lower surface of the upper raised portion *7a* of the collar 7. However, in accordance with this invention, when the inwardly projecting bead 16 is in the position as shown in FIGS. 5, 8 and 10, it becomes "locked" between the upper raised portion *7a* and the lower raised portion *7b* of the annular collar 7. In this manner, gradual outward motion of the skirt portion 12 is prevented, and the efficient fracture of closure 1 is obtained in the manner discussed herein.

Figure 6:
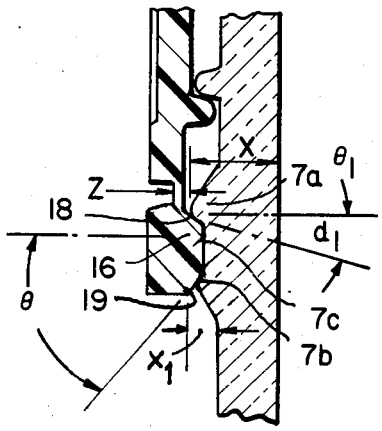
FIG. 6 is a partial, side, elevational, cross-sectional view of a portion of the tamper-evident container of FIG. 5.

In this regard, reference is also made to FIG. 6. The dimension X shown therein represents the diameter of the upper raised portion *7a* of the annular collar 7. This dimension X, when used for example in the container body employed in connection with U.S. Pat. No. 4,479,586, i.e., where only a single annular collar 7 is employed, will optimally be the dimension which, both permits the closure to be applied to the container without fracturing the bridges, and which at the same time can effect the fracture of the bridges upon removal thereof. If that precise, optimum diameter could be obtained in every case, there would in fact be no need for the improvements of the present invention. However, in actual operation this is generally not the case, and some variation from that optimum dimension must be taken into consideration. It is for that reason that 100% efficiency has not been obtainable, and therefore some of the closures have fractured upon application, and some of the closures have not fractured upon removal. In accordance with this invention, however, the dimension X of the diameter of the upper raised portion *7a* of the annular collar portion 7 of the container body can now be somewhat less than this optimum dimension X discussed above. Again, if the diameter X of the upper raised portion *7a* of the annular collar portion 7 of the present invention were employed in place of the optimum dimension X in the devices shown in these prior patents, for example, the annular collar portion 7 would then have a diameter which would not provide for efficient fracture, and the closure could consistently be removed from the container without fracturing. On the other hand, by employing that diameter in connection with the upper raised portion 7*a* of the present container body, it is now possible to apply this closure to the container body, and over the upper raised portion 7*a*, without the risk of prematurely fracturing the bridge members. Furthermore, by providing lower raised portion 7*b*, having essentially that same reduced diameter as upper raised portion 7*a*, and intermediate recessed "track" portion 7*c* therebetween, the inwardly projecting bead 16 becomes "locked" between the upper and lower raised portions 7*a* and 7*b*, as shown in FIGS. 5, 8 and 10, and it becomes essentially impossible to remove the closure from the container body without fracturing the bridge means.

Figure 2:
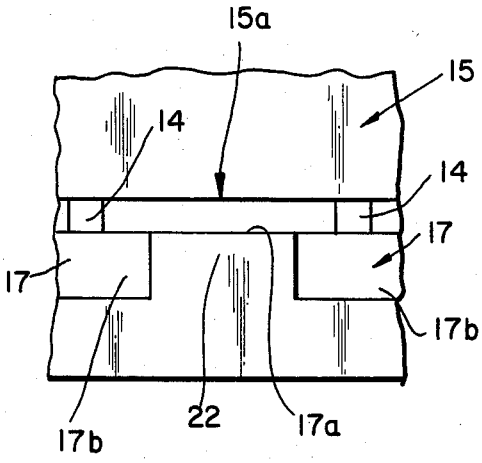
FIG. 2 is a side, elevational, enlarged view of a portion of the closure of FIG. 1.
Figure 3:
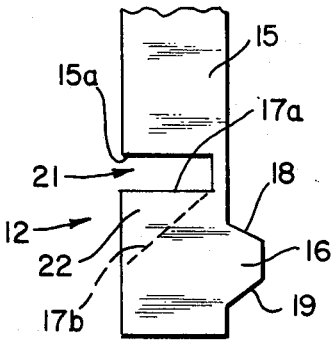
FIG. 3 is a side, cross-sectional elevational view of a portion of the closure of FIG. 1, which is shown in FIG. 2.

Returning again to the closure itself, as can be seen in FIGS. 1 through 4, an area of weakness is located in the intermediate side wall portion of the closure 1 above the annular bead portion 16 of the depending lower skirt portion 12, but below the internally threaded upper portion 11. In particular, a groove 21 is located on the outer surface of the closure 1. Groove 21 completely severs the intermediate side wall portions of the closure except for the remaining bridge portion(s) 14 which thus connects the upper and lower intermediate side wall portions formed by groove 21, designated as portions 15 and 17, as can best be seen in FIGS. 2 and 3. The bridges 14 preferably include a plurality of individual bridges located circumferentially around the closure, as is again shown in FIGS. 1 and 2. These bridges thus connect the upper and lower intermediate side wall portions 15 and 17, and preferably have a thickness represented by the distance Z as shown in FIG. 6, representing the distance between the bottom of groove 21 and the inner wall of the closure, and generally being a distance of from about 0.003 to 0.015 inches, preferably from about 0.006 to 0.010 inches, and most preferably about 0.008 inches, e.g. from about 0.007 to 0.009 inches. These bridges 14 are thus sufficiently thin and flexible such that as the closure 1 is being applied to the container body, the lower surface 19 of the bead 16 comes into contact with the upper surface of the upper raised portion 7*a* of the collar or bead portion 7 of the container, bridge portions 14 can collapse, and the upper and lower intermediate side wall portions 15 and 17 can come into direct abutment or contact with each other. In this manner, the pressures created during application of the closure are applied between these abutting surfaces, and are not substantially entirely placed upon the bridge portions 14 themselves. This, in turn, in conjunction with the use of reduced diameter X for the upper raised portion 7*a*, prevents premature fracture of the bridges 14 upon closure application. In other words, as the depending lower skirt portion 12 (i.e. the bead 16), of the closure 1 passes over the upper raised portion 7*a* and/or the lower raised portion 7*b* of the annular collar or bead portion 7 of the container, and flexes outwardly, this flexing motion is not transferred directly to the bridge portions 14, which can now collapse, but can instead now be applied uniformly across the abutting upper and lower intermediate side wall surfaces 15 and 17. Additional means for dealing with these pressures in a more preferred manner are discussed below, but in any event this procedure, including collapse of the bridge portions 14, permits the depending lower skirt portion 12 to pass completely over the raised portions 7*a* and/or 7*b* of the annular collar portion 7 of the container, as in the configuration shown for example in FIG. 5, without fracturing bridge portions 14, which thus retain their original configuration shown for example in FIG. 5, without fracturing bridge portions 14, which thus retain their original configuration, i.e. as shown in FIGS. 5, 8 and 10, with the upper and lower intermediate side wall portions now once again separated from each other and connected by bridge portions 14. In the particular embodiment shown in FIGS. 2 and 3, the surface of the lower intermediate side wall portion 17 is formed at an angle, as shown at 17*b*. However, in such a case it is far more preferable to include in at least a portion of the lower intermediate side wall portion 17 stabilizer means 22. As can best be seen in FIGS. 2 and 3, stabilizer means 22, which preferably include a plurality of stabilizer means located circumferentially around the closure, provide the lower intermediate side wall portion 17 with portions having a horizontal surface 17*a* which is juxtaposed with and parallel to the surface 15*a* of the upper intermediate side wall portion 15, both of which are now in the horizontal plane of the closure 1. These surfaces 15*a* and 17*a* thus come into contact with each other when the bridge portions 14 have collapsed, and the major portion of the pressures created by application of the closure 1 to the container as the skirt portion 12 flexes over the upper raised portion 7*a* and/or the lower raised potion 7*b* are applied through these surfaces, and not through the bridge portions 14. In addition, however, the entire lower intermediate side wall portion 17 can also constitute a flat surfce, i.e. one having the configuration of stabilizing means or tabs 22 (discussed in more detail below) all the way around the circumference of the closure, in which case there will be no inclined portion 17*b* between separate tabs 22. Preferably, however, even when the entire upper intermediate side wall portion 15 is a flat surface, as shown in FIGS. 2 and 3, there will be four tabs 22 located on the lower intermediate side wall portion, and preferably they will be located at 90° intervals equidistantly around the circumference of the closure, so as to uniformly support the upper intermediate side wall surface upon collapse of the bridge members 14, as well as in order to facilitate the manufacturing process for the closure. Thus, these spaced tabs 22 will preferably be located between the spaced bridge members 14, preferably with two such spaced bridge members 14 between each of the spaced tabs 22. Again, such a configuration is quite helpful in reducing the pressures applied to the bridge members 14 and preventing any premature fracture thereof.

Figure 11:
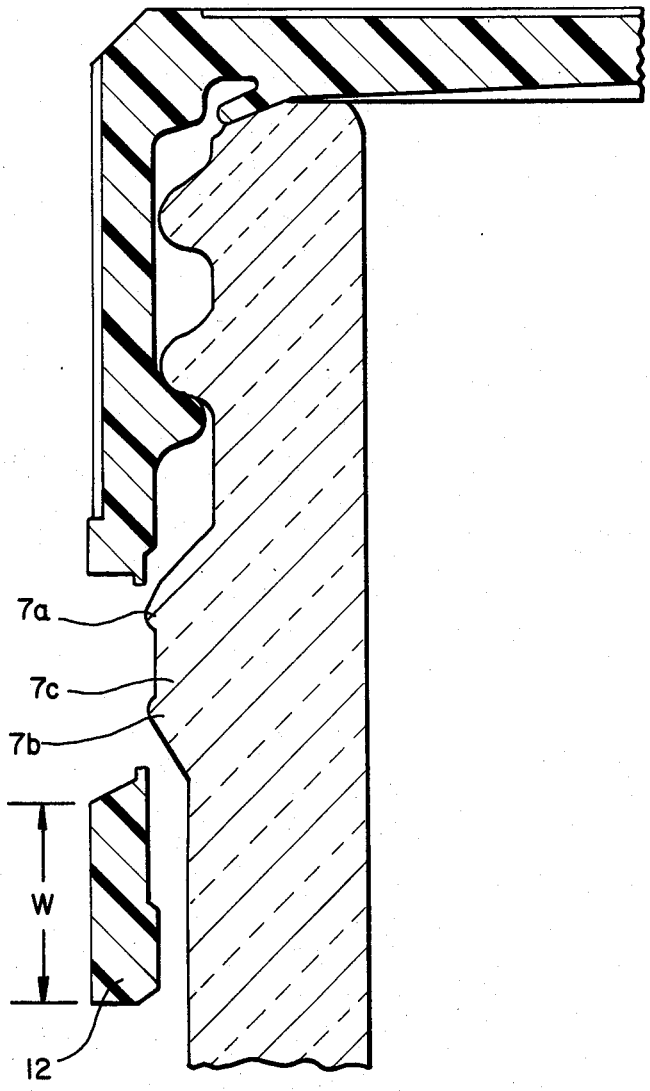
FIG. 11 is a side, elevational, partly cross-sectional view of the tamper-evident container of FIG. 9, including the depending lower skirt portion thereof subsequent to fracture.

In a preferred embodiment of this invention, as shown in FIGS. 9 and 11 hereof, the depending lower skirt portion 12 has an elongated width W which is long enough so that when the closure is completely applied, as shown in FIG. 9, the inwardly projecting bead 16 will be located below the lower raised portion 7*b* of the annular collar portion 7 of the container body. Upon removal of the closure, the inwardly projecting bead 16 will then pass over the lower raised portion 7*b* and into the "track" 7*c*, so that it is in essentially the same configuration as was the inwardly projecting bead 16 in connection with the embodiment shown in FIG. 8. Further removal of the closure from this point will cause fracture of the bridges in much the same manner as was the case in connection with the embodiment shown in FIG. 8, again leaving the depending lower skirt portion 12 affixed to the annular collar portion 7 at the track 7*c* of the container body. In this case, however, because of the increased dimension W, the upper end of the depending lower skirt portion 12 now projects upwardly to a point much higher than was the case in connection with the embodiment discussed in FIGS. 8 and 10. For this reason, referring now to FIG. 11, when the upper portion of the closure is screwed back onto the container body, the lower portion of the intermediate side wall of the upper portion of the closure will come into contact with the upper portion of the depending lower skirt portion 12 and drive it downwardly from the position shown in FIG. 9 to the position shown in FIG. 11, thus providing clear visual evidence of the fact that the container has once been opened, i.e. there is a clear discernable distance between the upper and lower portions of the closure.

Referring to FIG. 6, the inwardly projecting bead 16 of the depending lower skirt portion 12 includes an upper surface 18 which is inclined at an angle $\theta_1$ with respect to the horizontal. This angle $\theta_1$ is generally between about 30 and less than about 60°, and preferably about 45°, thus providing a surface which is abrupt with respect to the horizontal, i.e. across the closure. On the other hand, the lower surface 19 of the inwardly projecting bead 16 is generally inclined at an angle $\theta_2$ with respect to the horizontal. This angle, $\theta_2$, is generally greater than about 60°, up about to 80°, and preferably about 75°, thus providing a far more gradually inclined surface with respect to the horizontal, In this manner, after the closure 1 has been applied to container body 3, the upper surface 18 of the inwardly projecting bead 16 can firmly engage the bottle or container, again in the manner shown in FIG. 6. This, in turn, insures that upon unscrewing of the closure from the container body 3, the bridges 14 will fracture, leaving behind the lower depending skirt 12. On the other hand, the far more gradual slope of the lower surface 19 of the inwardly projecting bead 16 permits that bead to easily move over the surface of the upper raised portion 7*a* and/or the lower raised portion 7*b* of the bead 7 on the container body 3 during closure application, thereby protecting bridges 14 from premature fracture during such application.

In addition, the extent to which the inwardly projecting bead 16 projects inwardly from the inner surface of the outer cylindrical side wall of the closure, i.e. the distance $x_1$, as seen in FIG. 6, is a rather significant dimension in connection with this closure. Thus, this distance $x_1$should be between about 0.020 and about 0.040 inches, and preferably about 0.030 inches. The distance $x_1$ is also significant in terms of its relationship to the diameter $d_1$ of the container in the central depressed portion 7*c* between the upper and lower raised portions 7*a* and 7*b*, respectively. In particular, the diameter $d_1$ of the container in this "track" area, or central depressed portion 7*c*, should be sufficiently great so as to be in contact with the inner diameter of the bead 16. However, it should be less than the diameter of the container body of the upper and lower raised portions, 7*a* and 7*b*, and less than the diameter of the prior container bodies immediately below their annular collar portions 7, since the bead 16 will now be locked between the upper and lower raised portions 7*a* and 7*b*.

Figure 7:
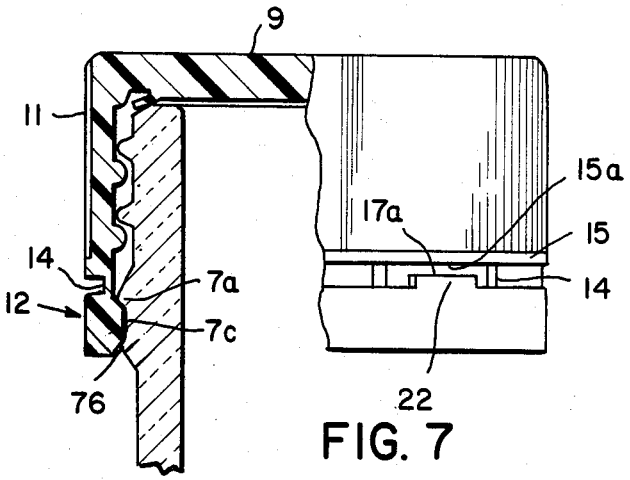
FIG. 7 is a side, elevational, partly cross-sectional view of a tamper-evident container of the present invention, prior to fracture.

In another embodiment, the stabilizing members 22 are in the form shown in FIG. 7. That is, in this form the upper surface 17*a* of the stabilizing members 22 are located above the point where the bridge members 14 are attached to the lower intermediate side wall portion 17. That is, the distance between the lower face 15*a* of the upper intermediate side wall portion 15 and the upper surface 17*a* of the stabilizing members 22 will be less than the overall length of the bridge members 14. In this manner, while the stabilizing members 22 still perform their function of accepting the pressures created during closure application and during collapse of the bridge members 14, in this case that collapse is not complete, or is only partial, since surfaces 15*a* and 17*a* will engage each other before the bridge members 14 have collapsed entirely, thus preventing any further such collapse, and further lessening the stresses applied to bridge members 14 during closure application. In addition, these types of stabilizers 22 also prevent the bridge members 14 from entirely collapsing during the molding of these closures and in much the same manner.

Referring again to FIGS. 1 and 7, groove 21 is formed in the outer wall of closure 1 in a manner such that when fracture occurs it occurs in a generally horizontal plane across the closure 1. Furthermore, such fracture occurs at a location above the lower depending skirt portion 12 such that the entire lower depending skirt portion 12 then remains (after fracture) engaged to the container body below the upper raised portion 7*a* of the bead 7, i.e. after internally threaded upper portion 11 has been completely removed from the container body. As can thus be seen, no part of the depending lower skirt portion 12 includes any weakened area therein.

Referring one again to FIG. 1, the outer surface of the internally threaded upper portion 11 can also include an area containing a plurality of vertical serrations 25 forming a roughened surface thereon. This surface has been found to be not only aesthetically appealing, but it also aides one in gripping the closure in order to twist it and thus fracture the bridges 14 and remove the internally threaded upper portion 11 therefrom.

As noted above, the closure 1 of the present invention is preferably made of a thermoplastic material, and can be manufactured in an injection molding process. Thus, the internal threads of the closure 1 can be formed by the action of an unscrewing mold. That is, after the part has been formed, during opening of the mold, the cores of the mold rotate and unscrew from the closure, thus forming the threads. The closure itself is kept from turning during this unscrewing phase by means of steel teeth, which engage in the bottom of the closure and hold it in place as the core rotates.

After the unscrewing cycle is completed, a stripper plate, which is part of the mold itself, ejects the finished closure from the mold. As the mold initially opens, and before the unscrewing cycle occurs, the closure is released from an undercut position in the mold by means of angle pins which cause cam bars to separate from around the closure. This undercut position was created because protruding portions of the mold (cams) were required in order to mold the annular groove, i.e. the weak portion of the closure which is intended to fracture.

The relationship between the internal diameter of this protruding groove in the cams to the outside diameter of the mold core determines the dimension "z" shown in FIG. 6 at the deepest part of the groove, i.e. the thickness of the bridge portions 14. It is also thus possible to change that dimension in the closure by merely replacing these cam sections.

The closure can also be manufactured without using this unscrewing procedure by the stripper plate pushing the closure from the stationary core, in a process known as the stripping process.

Further, as an alternate to the cam action, the outside groove can be machined into a solid section of the closure as a secondary operation to the inital molding step. The remainder of the molding process is the same as in conventional thermoplastic molding processes.

The various embodiments of this invention also include various sealing means therein, such as a yieldable sealing disc which can be made of cork or other such commercial lining materials, and other such sealing means, all of which are also shown in issued U.S. Pat. No. 4,343,408, and are also incorporated therein by reference thereto.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What I claim is:

1. A tamper-evident container comprising a container body including a threaded neck portion and an annular collar portion below said threaded neck portion and a closure for application to said container body, said closure comprising a one-piece plastic closure body including a horizontal end wall and a cylindrical side wall, said cylindrical side wall including an internally threaded upper portion, a depending lower skirt portion, and an intermediate side wall portion therebetween, said depending lower skirt portion including an inwardly projecting bead including an inner surface having a predetermined length, said intermediate side wall portion of said closure including a frangible portion comprising an area of weakness designed to fracture when said closure is removed from said container body so as to leave said depending lower skirt portion on said container body after said upper portion has been removed from said container body, said frangible portion dividing said intermediate side wall portion into an upper intermediate side wall portion and a lower intermediate side wall portion above and below said frangible portion, respectively, said frangible portion comprising bridge means located circumferentially around said closure, said bridge means being sufficiently thin and flexible so as to be capable of collapsing when said inwardly projecting bead passes over said annular collar portion of said container, said annular collar portion of said container body including an upper raised portion, a lower raised portion, and a central depressed portion therebetween, said central depressed portion having a diameter less than the diameter of said upper and lower raised portions and having a length corresponding to said predetermined length of said inner surface of said inwardly projecting bead on said depending lower skirt portion of said closure, whereby upon application of said closure to said container body said inwardly projecting bead is locked between said upper raised portion and said lower raised portion, and frictionally engages said central depressed portion of said annular collar portion of said container body to lock said inwardly projecting bead between said upper raised portion and said lower raised portion thereby facilitating fracture of said frangible portion of said closure upon removal of said closure from said container body.

2. The tamper-evident container of claim 1, wherein said upper and lower intermediate side wall portions are in substantial alignment with each other in the plane of said cylindrical side wall.

3. The tamper-evident container of claim 1, wherein at least a portion of said upper and lower intermediate side wall portions include juxtaposed parallel surfaces for providing surfaces for abutment of said upper and lower side wall portions upon the collapse of said bridge means.

4. The tamper-evident container of claim 3, wherein said lower intermediate side wall portion includes a plurality of stabilizer members.

5. The tamper-evident container of claim 1, wherein said bridge means comprises a plurality of bridge members located circumferentially around said closure.

6. The tamper-evident container of claim 5, including eight of said bridge members located equidistantly about said closure.

7. The tamper-evident container of claim 5, wherein said bridge members have a thickness of between about 0.003 and 0.015 inches.

8. The tamper-evident container of claim 1, wherein said inwardly projecting bead includes an inclined lower surface defining a plane disposed at a first angle with respect to the horizontal, for assisting in the gradual outward bending of said depending lower skirt portion as it passes over said upper raised portion of said annular collar portion of said container body upon said application of said closure onto said container body without fracturing said frangible portion, and an inclined upper portion defining a plane disposed at a second angle with respect to the horizontal for engagement with said upper raised portion of said annular collar portion of said container body when said inwardly projecting bead is locked between said upper raised portion and said lower raised portion of said annular collar portion of said container body, said first angle being greater than said second angle, whereby said depending lower skirt portion cannot gradually bend outward when said closure is removed from said container body without causing said fracture to occur.

9. The tamper-evident container of claim 8 wherein said first angle is between 60° and 80° with respect to the horizontal.

10. The tamper-evident container of claim 9 wherein said first angle is approximately 75° to the horizontal.

11. The tamper-evident container of claim 8 wherein said second angle is between 30° and 60° with respect to the horizontal.

12. The tamper-evident container of claim 11 wherein said second angle is approximately 45° to the horizontal.

13. The taper-evident container of claim 8 wherein the first angle is between 60° and 80° and the second angle is between 30° and 60° to the horizontal.

14. The tamper-evident container of claim 13 wherein the first angle is approximately 75° and the second angle is approximately 45° with respect to the horizontal.

15. A tamper-evident container comprising a container body including a threaded neck portion and an annular collar portion below said threaded neck portion and a closure for application to said container body, said closure comprising a one-piece plastic closure body including a horizontal end wall and a cylindrical side wall, said cylindrical side wall including an internally threaded upper portion, a depending lower skirt portion, and an intermediate side wall portion therebetween, said depending lower skirt portion including an inwardly projecting bead having a predetermined length, said intermediate side wall portion of said closure including a frangible portion comprising an area of weakness designed to fracture when said closure is removed from said container body so as to leave said depending lower skirt portion on said container body after said upper portion has been removed from said container body, said frangible portion dividing said intermediate side wall portion into an upper intermediate side wall portion and a lower intermediate side wall portion above and below said frangible portion, respectively, said frangible portion comprising bridge means located circumferentially around said closure, said bridge means being sufficiently thin and flexible so as to be capable of collapsing when said inwardly projecting bead passes over said annular collar portion of said container, said annular collar portion of said container body including an upper raised portion, a lower raised portion, and a central depressed portion therebetween, said central depressed portion having a diameter less than the diameter of said upper and lower raised portions and having a length corresponding to said predetermined length of said inwardly projecting bead on said depending lower skirt portion of said closure such that upon application of said closure to said container body said inwardly projecting bead is locked between said upper raised portion and said lower raised portion and frictionally engages said central depressed portion therebetween to lock said inwardly projecting bead between said upper raised portion and said lower raised portion thereby facilitating fracture of said frangible portion upon removal of said closure from said container body, wherein the diameters of said upper raised portion and said lower raised portion are less than the diameter required to provide for consistent fracture of said frangible portion of said closure upon removal of said closure from said container body.

16. A tamper-evident container comprising a container body including a threaded neck portion and an annular collar portion below said threaded neck portion and a closure for application to said container body, said closure comprising a one-piece plastic closure body including a horizontal end wall and a cylindrical side wall, said cylindrical side wall including an internally threaded upper portion, a depending lower skirt portion, and an intermediate side wall portion therebetween, said depending lower skirt portion including an inwardly projecting bead having a predetermined length, said intermediate side wall portion of said closure including a frangible portion comprising an area of weakness designed to fracture when said closure is removed from said container body so as to leave said depending lower skirt portion on said container body after said upper portion has been removed from said container body, said frangible portion dividing said intermediate side wall portion into an upper intermediate side wall portion and a lower intermediate side wall portion above and below said frangible portion, respectively, said frangible portion comprising bridge means located circumferentially around said closure, said bridge means being sufficiently thin and flexible so as to be capable of collapsing when said inwardly projecting bead passes over said annular collar portion of said container, said annular collar portion of said container body including an upper raised portion, a lower raised portion, and a central depressed portion therebetween, said central depressed portion having a diameter less than the diameter of said upper and lower raised portions and having a length corresponding to said predetermined length of said inwardly projecting bead on said depending lower skirt portion of said closure such that upon application of said closure to said container body said inwardly projecting bead is locked between said upper raised portion and said lower raised portion, and frictionally engages said central depressed portion therebetween to lock said inwardly projecting bead between said upper raised portion and said lower raised portion thereby facilitating fracture of said frangible portion upon removal of said closure from said container body, wherein said depending lower skirt portion of said closure has a predetermined length, said predetermined length being such that upon complete application of said closure to said container body said inwardly projecting bead passes over said lower raised portion of said annular collar portion of said container body and becomes locked between said upper raised portion and said lower raised portion of said annular collar portion of said container body to thereby facilitate said fracture of said frangible portion of said closures as said closure is further removed from said container body, and furthermore whereby upon subsequent reapplication of said upper portion of said closure to said container body, said upper portion of said closure forces said depending lower skirt portion of said closure downwardly over said lower raised portion of said annular collar portion of said container body so as to provide visual evidence of said fracture.

* * * * *